United States Patent [19]

Hoffend, Jr. et al.

[11] 4,303,237

[45] Dec. 1, 1981

[54] ARRANGEMENT FOR SUPPORTING THEATRICAL EQUIPMENT

[76] Inventors: Donald A. Hoffend, Jr., 3 Lake LaComa Dr., Pittsford, N.Y. 14534; Nicholas G. Cristy, 31 Brighton Park, Rochester, N.Y. 14620

[21] Appl. No.: 119,032

[22] Filed: Feb. 6, 1980

[51] Int. Cl.[3] ..... B66C 23/60; A63J 1/02

[52] U.S. Cl. ..... 272/22; 272/24

[58] Field of Search ..... 272/12, 22, 24, 21, 272/23

[56] References Cited

U.S. PATENT DOCUMENTS 766,238 8/1904 Garrett ..... 272/22 X 4,199,133 4/1980 Gagnon et al. ..... 272/22 X

*Primary Examiner*—George J. Marlo

[57] ABSTRACT

Theatrical equipment including riggings sets, light fixtures and the like are supported from a batten which is elevated and lowered relative to a stage floor by a plurality of ropes. The ropes are coupled to the batten and depend from a rectilinear array of rotary bodies mounted aloft. A mechanical coupling device intercouples the rotary bodies for providing simultaneous rotation of the bodies. An electrically energized drive device is also mounted aloft and is coupled to the array for causing rotation of the bodies. A locking device is mounted aloft and engages the coupling device for selectively enabling and inhibiting rotation. The ropes are coupled to the rotary bodies for causing ropes of different bodies to travel in laterally opposite directions for offsetting potential lateral movement of the batten. A plurality of rectilinear arrays of rotary bodies is provided which extends between a proscenium wall and a rear stage wall.

13 Claims, 13 Drawing Figures

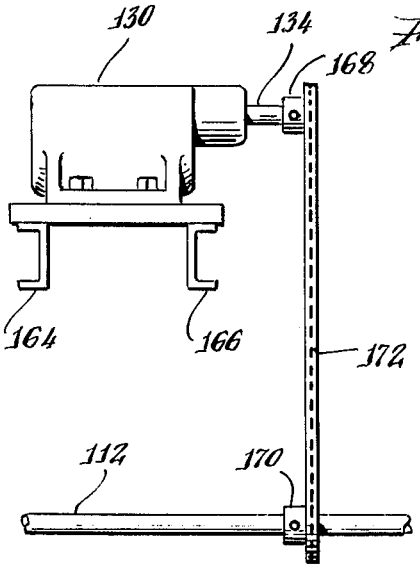
Fig. 8.
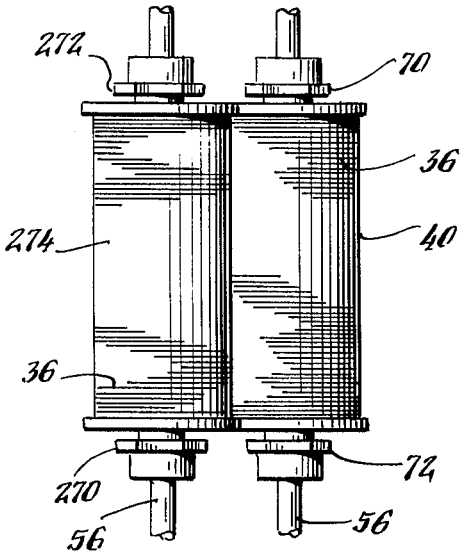
Fig. 10.
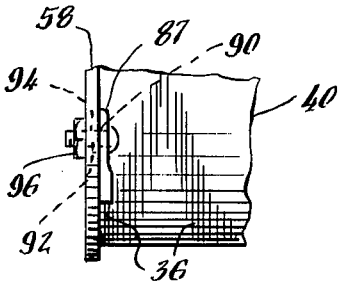
Fig. 11.
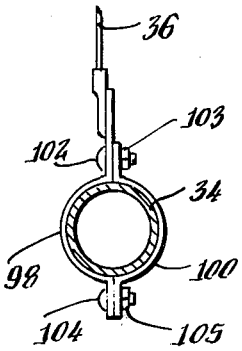
Fig. 12.
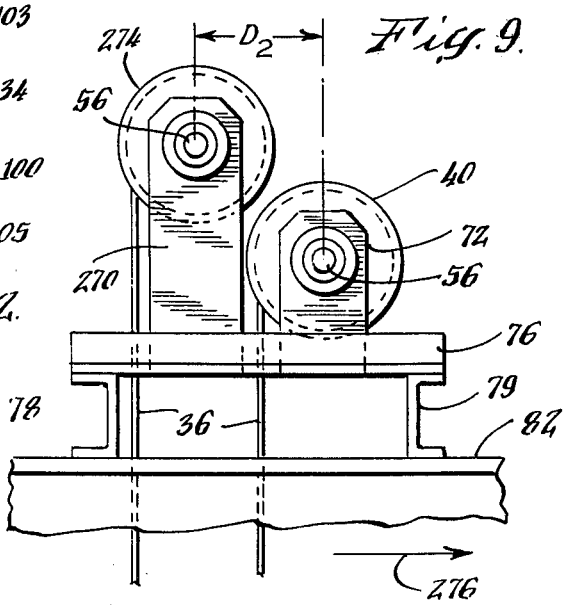
Fig. 9.
Fig. 13.
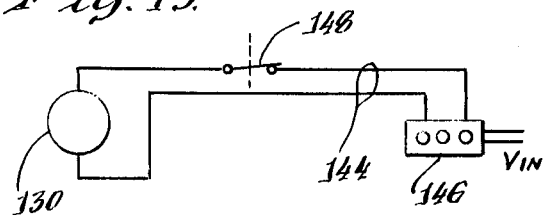
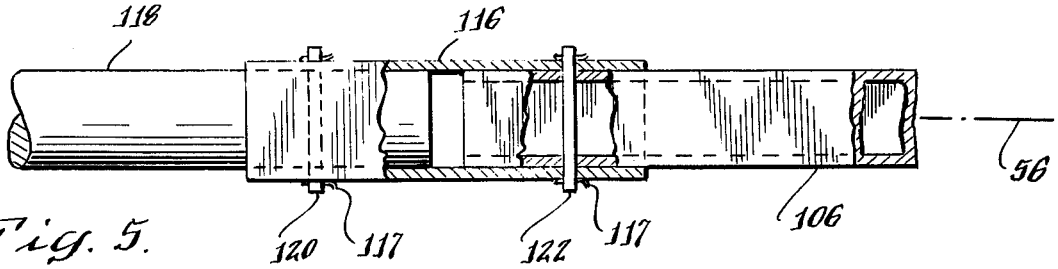
Fig. 5.

ARRANGEMENT FOR SUPPORTING THEATRICAL EQUIPMENT

BACKGROUND OF THE INVENTION

1. Field of the Invention

This invention relates to theatrical equipment and more particularly to an improved arrangement for raising and lowering a batten which supports theatrical equipment.

2. Description of the Prior Art

Theatrical stage equipment includes equipment which is required to be raised and lowered prior to and during a performance, in order to provide a desired scene effect. This equipment includes various rigging sets such as curtains, borders, screens, scene displays, and, various lighting fixtures. The rigging sets, which are generally coextensive in length with a proscenium opening of the theatre can be of substantial area and these sets, as well as the rigging lighting can have substantial weight. In relatively large theatres adapted for elaborate scene changes, the aforementioned rigging sets can number as many as about seventy which are generally aligned in parallel with the proscenium opening.

Rigging sets are generally secured to and are supported along a length by relatively narrow, elongated bodies known as battens. The batten typically comprises an elongated pipe, rod or rigid strip of material. Each batten is supported along its length by a plurality of flexible ropes which comprise, for example, wire ropes, manila ropes, etc. Elevating and lowering the batten is accomplished by an arrangement which includes a plurality of pulleys, a counterweight known as an arbor, an arbor pulley and an arbor drive block. Each of the plurality of ropes extends from a batten to an associated pulley which is mounted aloft and converge toward, extend about in engagement with, and extend away from the head block vertically downward and are coupled to the counterweight arbor. A rope which is coupled at two points to the arbor extends to a pulley mounted aloft and, at stage level, to an arbor drive block. Movement of the arbor rope is accomplished either manually by hand, or by driving the arbor block with an electric motor. The arbor is thus raised and lowered resulting in vertical motion of the batten and the supported rigging set.

It will be appreciated that in the relatively larger stage arrangements, the aforementioned rigging set support including ropes, pulleys, head block, arbor, arbor pulley and arbor drive mechanism occupies substantial space both aloft and at stage floor. The arbor drive is positioned on the stage floor and arbor drive ropes extend vertically from the stage floor at a location at side stage. This utilizes a substantial area of side stage floor space and this requirement becomes pronounced in relatively large theatrical arrangements wherein the rigging sets number up to about seventy. The raising and lowering of a relatively large number of battens supporting theatrical equipment thus places a substantial demand on the available stage space and increases the complexity of the arrangement.

In addition to providing a means for raising and lowering the batten, it is also desirable, from a safety viewpoint, to provide a means for locking a batten at a selected height so as to inhibit an accidental failure and a rapid uncontrolled descent of a rigging set which can result in injury to parties in the vicinity of the falling set.

The aforementioned arrangement provides for locking through inhibiting rotation of the arbor drive pulley, either through a ratchet locking means or a brakeshoe arrangement. A safety lock is thus provided at stage level and suffers from the disadvantage that the locking is mechanically remote from the supported batten in that the locked member is coupled to the batten through intermediate members which are susceptible to failure.

SUMMARY OF THE INVENTION

Accordingly, it is an object of the invention to provide an improved arrangement for elevating and lowering batten supported stage equipment.

Another object of the invention is to provide an improved arborless rigging set arrangement.

Another object of the invention is to provide an improved rigging set arrangement which provides for relatively efficient use of space aloft and stage floor space.

Another object of the invention is to provide an improved rigging set arrangement wherein the principal members are supported aloft.

A further object of the invention is to provide an arrangement for elevating and lowering batten supported stage equipment and which is adapted for coupling a prime mover to different locations of the arrangement.

Another object of the invention is to provide an improved arrangement for elevating and lowering batten supported stage equipment and which is adapted to provide a positive safety lock at a location which is relatively mechanically close to the batten.

Another object of the invention is to provide an improved arrangement for relatively close, juxtaposed positioning and support of a plurality of battens supporting theatrical stage equipment.

In accordance with features of the invention an arrangement for elevating and lowering batten supported theatrical equipment includes a plurality of rotary bodies which are aligned in a rectilinear array and are supported aloft above a stage floor. A mechanical coupling means provides coupling between the array of bodies and provides for simultaneous rotation of the bodies of the array. An electrically energized drive means is provided, is mounted aloft and is coupled to the rectilinear array for causing rotation of the bodies. Elongated, flexible rope means extend from the rotary bodies and are mechanically coupled to a batten at spaced apart locations along a length of the batten. The rope means is mounted to the rotary bodies for causing winding of the rope about its associated rotary body during rotation in a first direction for elevating a batten and for unwinding the rope from said body during rotation in an opposite direction for lowering the batten. In accordance with more particular features of the invention, the mechanical coupling means is demountable, the rotary bodies comprise a plurality of cylindrically shaped bodies and the rectilinear array is aligned parallel with and substantially coextensive with the length of a proscenium opening of the theatre.

In accordance with further features of the invention, the ropes are mounted to the rotary bodies for providing that horizontal travel of ropes of adjacent rotary bodies occurs in opposite directions whereby the ropes advance toward each other upon rotation of the bodies in a first direction and advance away from each other upon rotation of the bodies in an opposite direction. The mechanical coupling means is adapted for movement in an axial direction in order to facilitate mounting and demounting of components of the arrangement.

In accordance with other features of the invention, a plurality of rectilinear arrays are provided, are aligned in parallel, and are aligned in parallel with and extend coextensively with the length of the proscenium opening. The rotary bodies are supported aloft by a plurality of support bodies extending transversely to the rectilinear arrays.

The invention is substantially advantageous in that it removes a substantial amount of theatrical equipment from the stage floor, eliminates the need for a counterweight arbor, permits relatively close positioning of rigging sets, facilitates the coupling of primary drive movers to the arrangement and enables the relatively close mounting of a locking means.

BRIEF DESCRIPTION OF THE DRAWINGS

These and other objects and features of the invention will become apparent with reference to the following specification and to the drawings wherein:

FIG. 5 is an enlarged, fragmentary view of a demountable rotary transmission coupling means utilized with the arrangement of FIG. 2;

FIG. 8 is a fragmentary view of another alternative drive arrangement of the batten support arrangement of FIG. 2;

FIG. 9 is a side elevation view of rotary bodies illustrating an alternate mounting of juxtaposed transversely aligned rotary members;

FIG. 10 is a fragmentary plan view of the arrangement of FIG. 9;

FIG. 11 is a fragmentary view of a rotary body illustrating the mounting of a rope thereto;

FIG. 12 is a fragmentary sectional view of a batten illustrating the coupling of a rope thereto; and, FIG. 13 is a schematic diagram of a circuit arrangement for energizing an electric drive means of FIG. 2.

DETAILED DESCRIPTION

Figure 1:
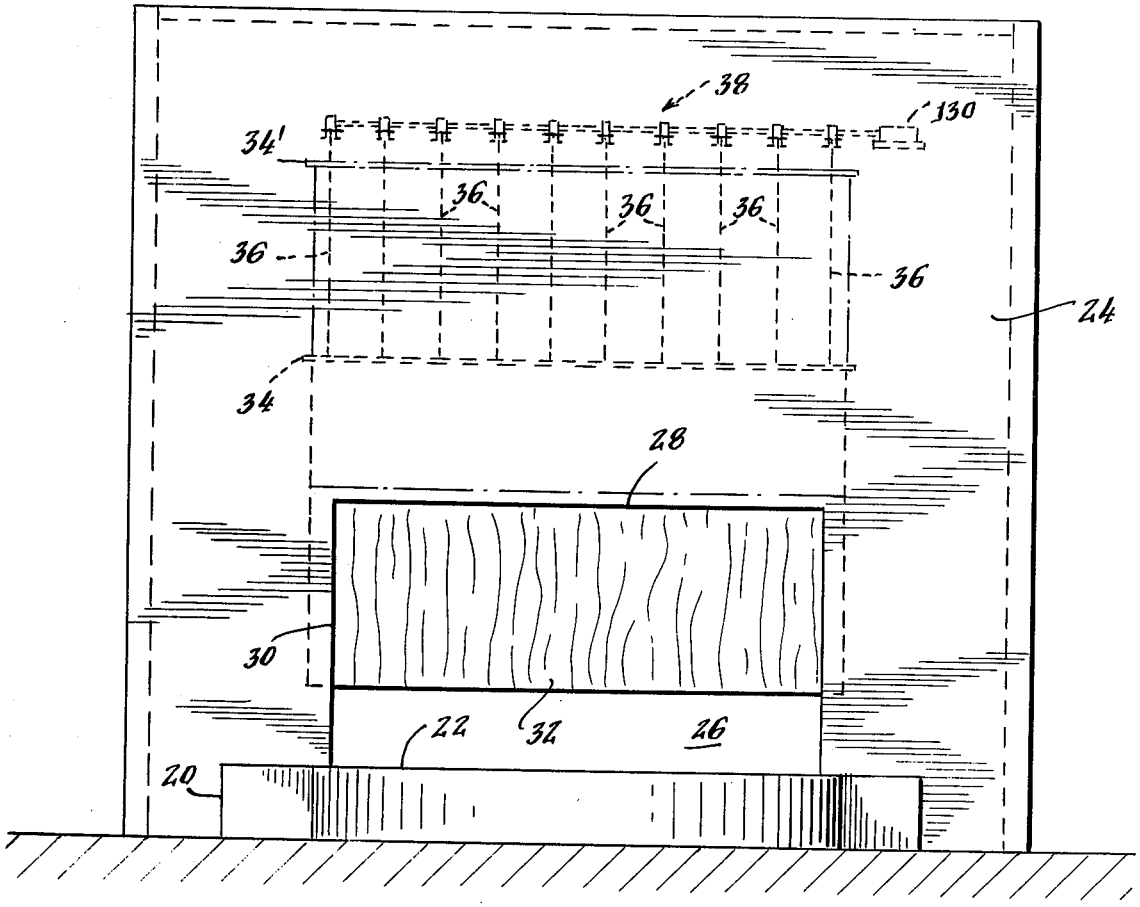
FIG. 1 is an elevation view of a theatre stage illustrating a proscenium wall opening and a rigging set supported by a batten support arrangement constructed in accordance with features of this invention.

Referring now to FIG. 1, a theatre is shown to include an elevated stage 20 having a stage floor 22, and, a proscenium wall 24 having an opening 26 formed therein. The proscenium opening 26, as is well known, frames the scene during an artistic performance. The proscenium opening 26 has a width 28 and a height 30 extending vertically from the floor. Visible through the proscenium opening 26 is a partly lowered batten supported rigging set 32. The rigging set 32 can comprise artistically designed scenes, framing curtains, projection screens, etc. Other batten supported theatrical equipment includes, for example, lighting fixtures for providing the desired lighting effects for the scene. The rigging set 32 is mounted along its length to a batten 34 and the batten 34 is supported by a plurality of ropes 36 depending from an array 38 of rotary bodies which are described in greater detail hereinafter. The array 38 is supported aloft above the stage floor 22 at a height sufficient for elevating the rigging set 32 above the upper width 28 of the proscenium opening 26 so that it is no longer visible to an audience. The elevated position of the support batten is represented by referenced numeral 34'. The term aloft as used in this specification and in the accomanying claims refers to the vertical location of a body above the level of the upper width 28 of the proscenium opening 26.

Figure 2:
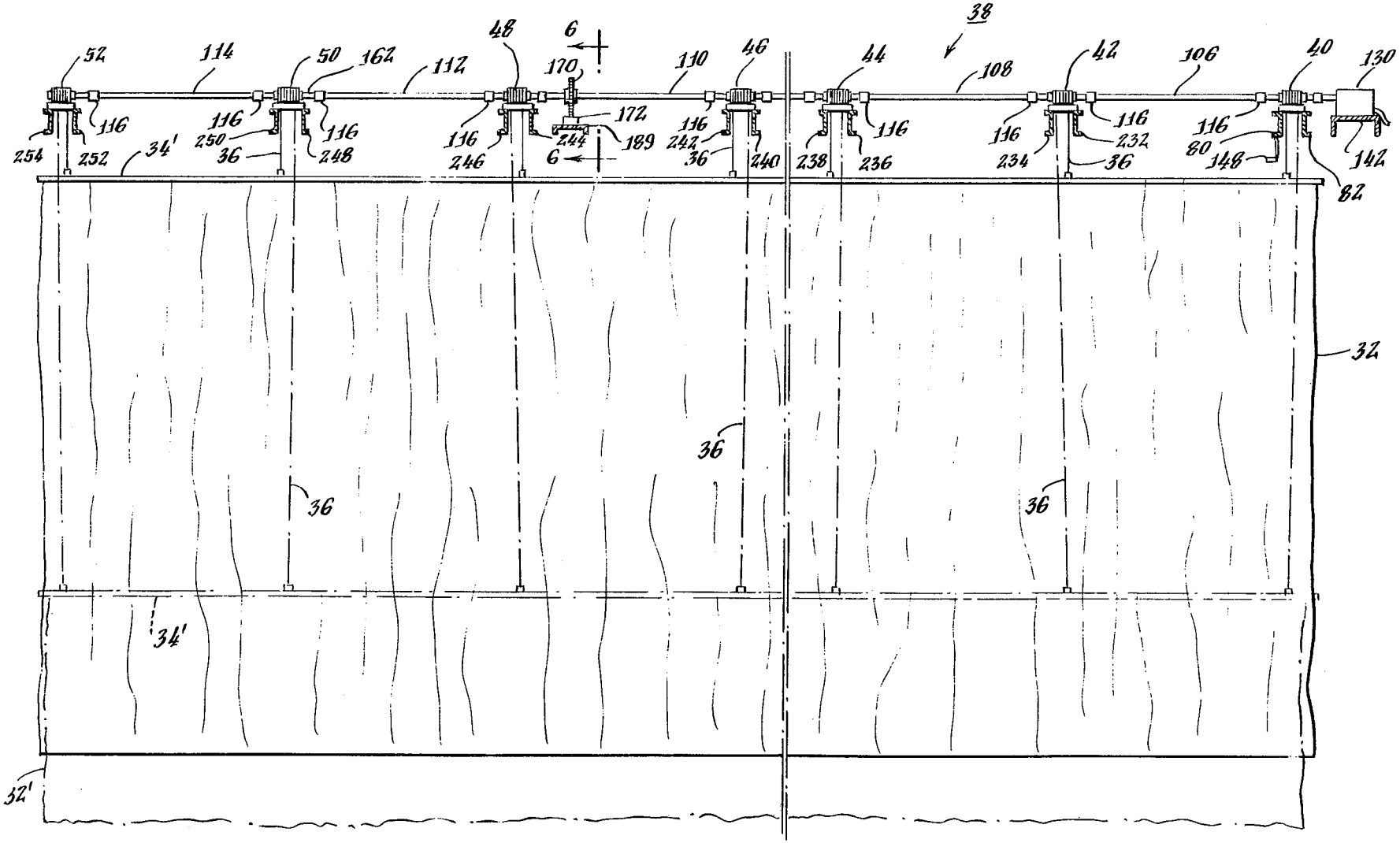
FIG. 2 is a fragmentary, enlarged, front elevation view of the batten support arrangement of FIG. 1.

As shown in FIG. 2 the array 38 of rotary bodies comprises a rectilinear array of bodies 40–52 which are spaced apart along the length of the rectilinear array and extend parallel to the proscenium wall 24. Other orientations of the rectilinear array can be provided when desired. The rotary bodies, as exemplified by the body 40, which is shown in detail in FIG. 4, comprises a cylindrically shaped body member 54 having a longitudinal axis 56 and end flange members 58 and 60 which are mounted to the body member 54 by welding, for example. Support shafts 62 and 64 are mountd to the flanges 58 and 60 respectively by welding, for example, and this assembly is rotatably supported in roller bearings 66 and 68. The roller bearings 66 and 68 are mounted to vertically orientated support plates 70 and 72 respectively which are mounted to angles 74 and 76 by welding, for example. Angles 74 and 76 are supported on and are welded to channels 78 and 79, as best seen in FIG. 9. Channels 78 and 79 are spaced apart and extend in the direction of the rectilinear array. A support means comprising first and second support members shown to be spaced apart channels 80 and 82 extend transversely to the rectilinear array 38 in a direction between the proscenium wall 24 and the rear stage wall 84. These members, in one arrangement, are mounted to and are supported by the proscenium wall 24 and the rear stage wall 84.

A flexible, elongated support body comprising a rope 36, preferably a wire rope, is secured to the body 40 for rotation therewith and for winding and unwinding about an outer cylindrical surface of the member 54 as the rotary body 40 rotates respectively in first and second opposite directions. The wire rope 36, as illustrated in FIG. 11, is swaged to a connector 87 which is mounted to a distal end of the rope. The connector includes an aperture 90 formed therein and a bolt 92 extends through this aperture and through an adjacent bore 94 in the flange plate 58 with which the aperture 90 is aligned. A nut 96 engages a threaded end of the bolt 92 thereby securing the rope 36 to the plate 58 and to the cylindrical body 40. The rope 36 is coupled at the opposite distal end to the tubular batten 34, as illustrated in FIG. 12, by swaging to a semi-circular bracket member 98. The bracket member 98 is positioned about the tubular shaped batten 34 and a second bracket member 100 is positioned in alignment therewith. Bolts 102 and 104 extend through aligned apertures in the brackets and are secured by nuts 103 and 105 respectively, thereby coupling the brackets to the batten 34 for supporting batten 34 at a location along its length.

Figure 4:
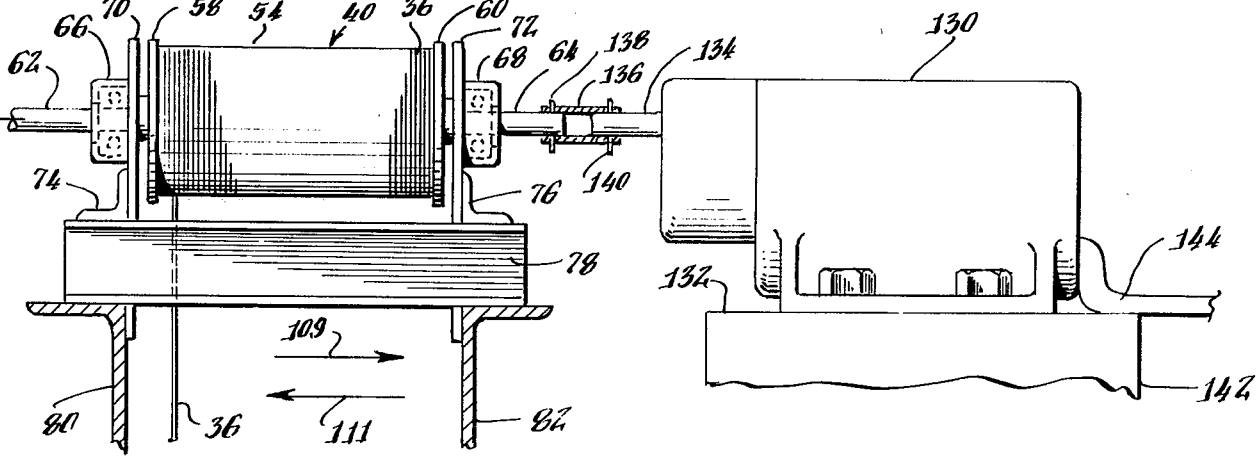
FIG. 4 is an enlarged, fragmentary view of a rotary body and a drive means taken along lines 4—4 of FIG. 3.

Clockwise rotation of the rotary body 40 as viewed in FIG. 4 in a direction indicated by arrow 107 results in winding of the rope 36 about the body 40 and linear travel of the extending rope 36 in a direction indicated by arrow 109 and parallel to the longitudinal axis 56. The total linear distance $D_1$ traveled by the rope 36 from an unwound and fully lowered rigging set position to a wound and fully elevated position, and which is referred to as the winding fleet, is dependent upon the diameter of the rotary body 40 and the diameter and length of the rope 36. The winding fleet $D_1$ should be no greater than the distance between the flanges 58 and 60, and preferably less. The direction of the winding fleet is determined by the location of the rope 36 on the body 40. As indicated, when the rope is mounted at flange end 58, the winding fleet will be in a direction indicated by arrow 109 for a clockwise rotation viewed in the direction of arrow 107. Similarly, when the rope 36 is mounted adjacent flange 60 for the same clockwise rotation, as viewed in the direction 107, the winding fleet of the rope will be in an opposite direction, as indicated by arrow 111 in FIG. 4. It will be observed in FIGS. 4 and 9 that the rotary body 40 is supported on spaced apart channels 78 and 79 and a vertical clearance is provided between these channels and between the transversely extending support members 80 and 82 for enabling unimpaired linear movement of the rope 36.

The linear movement of a rope 36, as previously described, can undesirably cause corresponding linear movement of the supported batten and offset of the rigging set. In order to reduce such offset, the ropes of adjacent bodies of a linear array are mounted to the rotary body for causing linear movement in opposite directions of the adjacent ropes. The resulting offset forces are thereby neutralized. The use of an even number of rotary bodies and ropes will substantially eliminate offset while in the case of an odd number of rotary bodies and ropes, the offset resulting from a single uncompensated linear movement is tolerable.

A means for mechanically intercoupling the array of rotary bodies 40–52 for causing simultaneous rotation of these bodies comprises a plurality of elongated drive shafts 106–114. Each of the drive shafts intercouples the rotary drive shaft of adjacent rotary bodies to provide a continuous rotary drive train between the distal located rotary bodies 40 and 52 of the rectilinear array 38. The application of a rotary force at any point in the drive train results in simultaneous rotaton of each of the drive shafts 106–114 and each of the rotary bodies 40–50 of the rectilinear array 38.

In order to facilitate mounting and demounting of the components of the rectilinear array, the drive shafts 106–114 are demountably coupled to the drive shafts of the rotary bodies. Coupling is provided in a preferred arrangement through the use of coupling sleeves 116, one of which is illustrated in detail in FIG. 5. In this figure, the coupling shaft 106 is illustrated coupled to a rotary shaft 118 of the rotary body 42 by the coupling sleeve 116. The shaft 118 is preferably cylindrically shaped and engages the associated support roller bearing (FIG. 4) while the coupling sleeve 116 and the shaft 106 are tubular and are of rectangular cross sectional configuration. Alternatively, sleeve 116 and shaft 106 can be configured with combinations of circular and rectangular cross sections. As illustrated in FIG. 5, the shaft 118 is cylindrical, the drive shaft 106 is tubular and rectangular in cross section and the coupling sleeve 116 is similarly tubular and rectangular in cross section. Alternative combinations provide for a sleeve of rectangular cross section 116 with a tubular drive shaft 106 of circular cross section and a tubular sleeve 116 of circular cross section with a tubular drive shaft 106 of circular cross section. The length of the drive shaft 106 is selected to be shorter than the axial distance between distal segments of rotary shafts of adjacent rotary bodies of the rectilinear array thus enabling the shaft 106 to be advanced and to telescope within the sleeve 116 for enabling removal of the shaft from the sleeve at opposite end thereof. Pins 120 and 122 are provided and extend through aligned bores formed in the shafts 106 and 118 and the sleeve 116 to inhibit axial movement of the sleeve 116 and the shaft 106 during operation. The pins which are readily placed and removed for initial installation and maintenance of the components are secured by cotter pins 117.

An electrically energized drive means 130 is provided, as illustrated in FIG. 4, for causing rotary motion of the rectilinear array 38, of rotary bodies. The drive means 130 comprises an integrally assembled electrically driven motor and a speed reducer. An armature shaft of the motor is coupled to the speed reducer (not illustrated in detail in FIG. 4) and an output shaft 134 of the speed reducer is coupled to the shaft 64 of the rotary body 40 by a coupler sleeve 136 or, alternatively, by a flexible coupling member (not illustrated). The coupling sleeve 136 is secured to the shafts 134 and 64 by pins 138 and 140. The electrical drive means 130 is mounted aloft on a support surface 132 of a transversely extending support member 142. The latter member is supported, for example, by the proscenium and rear stage walls 24 and 84 respectively. Electrical energy is coupled to the drive means 130, as illustrated in FIG. 13, via an electrical cable 144 from a source of potential (V). Voltage is applied to the drive means 130 through a manually operated switch 146 located at a control panel which is positioned near stage floor level and by a limit switch 148 extending from a transverse support member (FIG. 2). Switch 148 is automatically actuated by the batten 34 for interrupting actuation of the drive means 130 when the batten reaches a predetermined limiting height. The direction of motion of the rotary bodies and the corresponding elevation or descent of the batten supported theatrical equipment is manually selectable at the switch 146. A rigging set for supporting theatrical equipment can be relatively heavy and can weigh up to as much as about 1,500 lbs. The electrically energized means for permitting rotary motion of the rotary bodies for a load of this capacity comprises a 3 H.P. brake type motor having, for example, a Windsmith Mfg. Co. No. 7 Speed Reducer.

Figure 7:
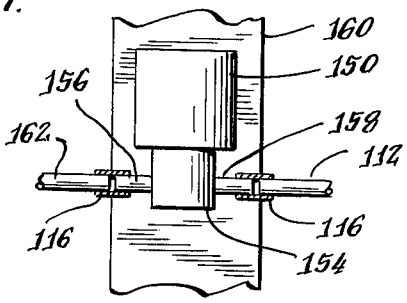
FIG. 7 is a fragmentary plan view of an alternative drive arrangement of the batten support arrangement of FIG. 2.
Figure 3:
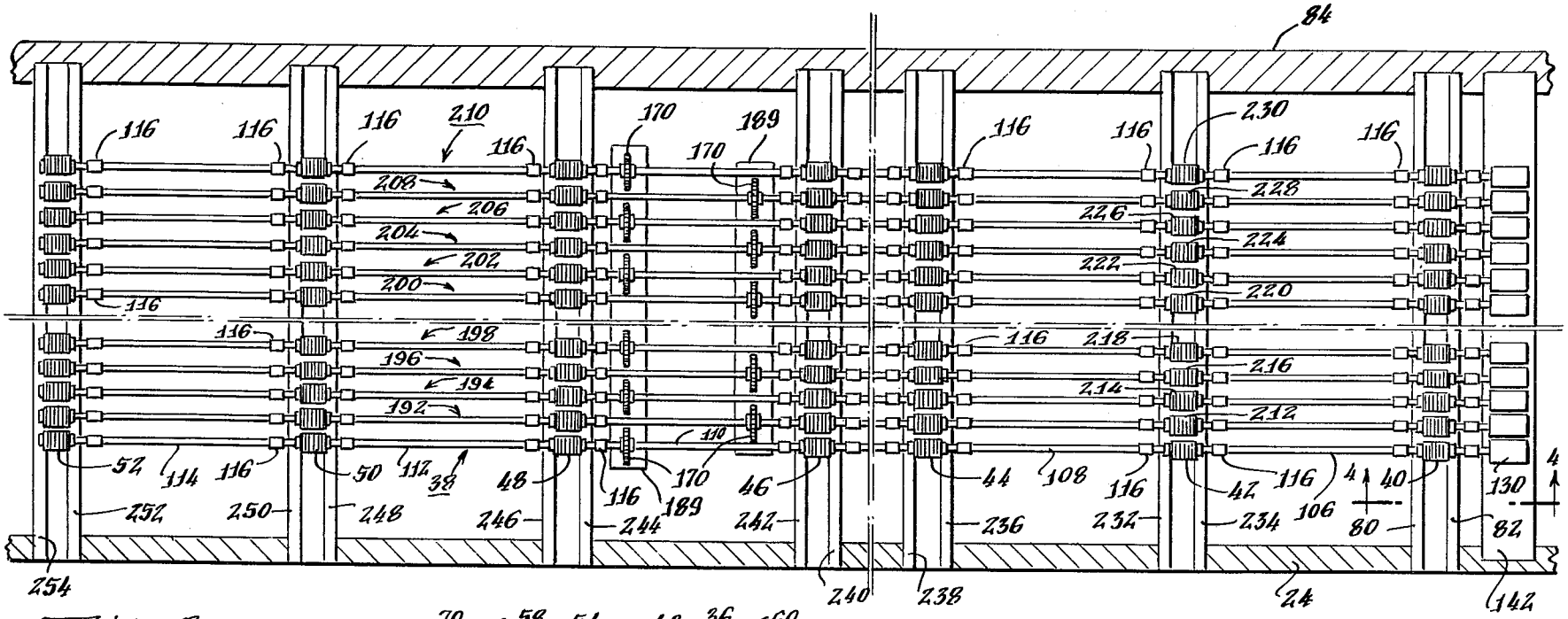
FIG. 3 is a plan view of the batten support arrangement of FIG. 2 illustrating a plurality of rectilinear arrays of rotary bodies and associated drive means.

The rectilinear array 38 of FIGS. 2 and 3 is shown to be shaft driven by the output reducer shaft 134 which is coupled to a distal rotary body 40 of the rectilinear array. The rectilinear array 38 may alternatively be shaft driven at an intermediate location as is illustrated in FIG. 7. An electrically energized drive means 150 as shown in plan view in FIG. 7, is mounted aloft on a transverse support member 160 so as to provide axial alignment between the output shaft 156 and a rotary shaft 162 of rotary member 50, for example, and axial alignment between the output shaft 158 and the drive shaft 112. Coupling sleeves 116 are coupled between the shaft 162 and the shaft 158 to impart rotary motion to the shafts 162 and 112.

An alternative coupling drive arrangement is illustrated in FIG. 8 which provides a flexible means between the reducer output shaft 134 and the drive train. The electrically energized means 130 is shown mounted aloft on transversely extending members 164 and 166. A cog wheel 168 is mounted on the shaft 134 while a cog wheel 170 is mounted to the drive shaft 112. A flexible chain drive 172 is coupled between the cogs 168 and 170 for imparting rotary motion to the shaft 112 upon rotary motion of the reducer shaft 134. While the arrangement of FIG. 8 illustrates the use of a flexible chain coupling to an intermediate location along the drive train of the mechanical intercoupling means, a flexible chain coupling may also be coupled to a drive shaft of a distal rotary member such as the drive shaft 64 of the member 40.

Figure 6:
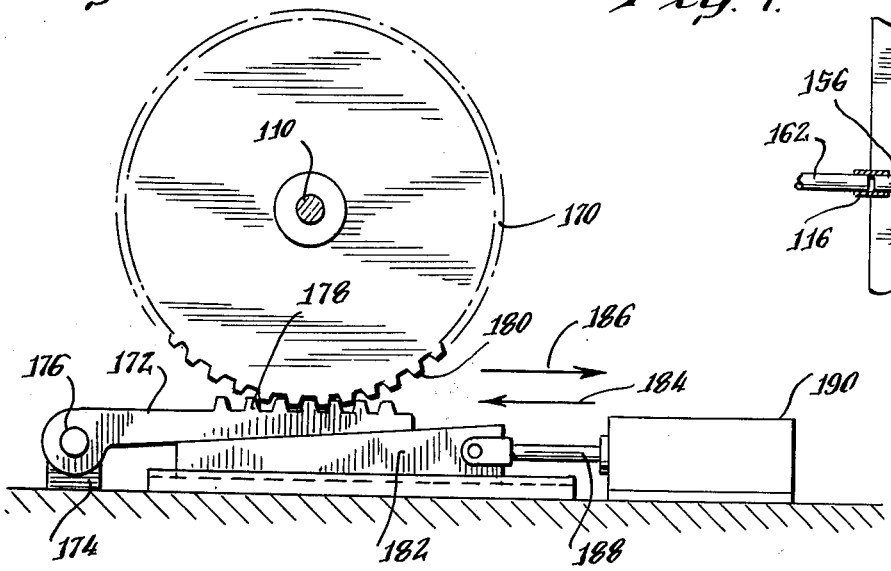
FIG. 6 is an enlarged, fragmentary view of batten support lock means taken along lines 6—6 of FIG. 2.

The electrical drive means 130, as indicated hereinbefore, includes brake shoe means for locking the motor armature shaft and the output shaft 134. A positive locking means is also provided and is coupled to the drive train of the mechanical intercoupling means. Referring now to FIGS. 2 and 6, a ring gear 170 is shown mounted to the drive shaft 110 for rotation therewith. Positioned adjacent to and below the ring gear 170 is a tapered lever arm 172 which is pivotally mounted to a post 174 by a pin 176 and which includes a plurality of gear teeth 178 formed along a length thereof and adapted for engagement with gear teeth 180 of the ring gear 170. The lever arm 172 is supported on a wedge shaped body 182. Body 182 is adapted to be advanced in a direction 184 and to be retracted in the direction 186, indicated by the arrows in FIG. 6. Upon advancement of the wedge shaped body 182 a sliding engagement with the lever arm 172 causes counterclockwise rotation (as viewed in FIG. 6) of the lever arm 172 an forces engagement between gear teeth 178 and 180 thereby inhibiting rotation of the gear 170 and the shaft 110 and thereby locking the drive train. Retraction of the body 182 in the direction 186 enables the lever arm 172 to rotate in a clockwise direction thereby disengaging the gear teeth 178 and 180 and enabling rotation of the drive train. The sliding wedge shaped member 182 is maintained in an advanced position by a spring loading means (not illustrated) and is retracted during operation in the direction 186 by a drive shaft 188 which is operated by an electrically energized solenoid 190, or, alternatively by a pneumatic drive means.

Referring once again to FIG. 3, a plurality of rectilinear arrays 38, 192–210 of rotary bodies described hereinbefore is provided. The plurality of arrays are aligned in parallel and extend in a transverse direction to the length of the rectilinear arrays between the proscenium wall 24 and the rear stage wall 84. The rotary bodies of juxtaposed rectilinear arrays are aligned in a direction extending transverse to the rectilinear arrays and between the proscenium wall 24 and the rear stage wall 84, as is illustrated in FIG. 3 by the transverse alignment of the rotary bodies 42, 212–230. Through this alignment each of these rotary bodies is supported on a pair of transversely extending support members 232 and 234. Similar pairs of transversely extending support members 232–254 are provided for supporting similar transversely extending arrays of rotary bodies.

Transverse spacing of the longitudinal axes of the rotary bodies 42, 212–230 of FIG. 3 is established at a distance no less than the diameter of the flanges (58, 60 FIG. 4) of the rotary bodies. At times, it is desirable to provide relatively closer spacing of the rigging sets 32 than can be provided with the arrangement of FIG. 3. An alternative mounting arrangement for reducing the transverse spacing between the longitudinal axes of juxtaposed rotary bodies is illustrated in FIGS. 9 and 10. Spacing less than the diameter of flanges is accomplished by supporting juxtaposed rotary bodies at different heights. This is accomplished by the use of bearing support plates 270 and 272 for a supported rotary body 274 which are greater in length than the bearing support plates 70 and 72 for the rotary body 40. Relatively closer nesting in a transverse direction 276, as shown in FIG. 9, is provided thereby enabling spacing of the longitudinal axes 56 of the bodies at a distance $D_2$ which is less than the diameter of the bearing support flanges.

An improved batten support arrangement has thus been described. This arrangement is advantageous in that it eliminates the use of a counterweight arbor at stage floor level thus freeing substantial side stage space for other theatrical uses and removing the complexity of the presence of numerous ropes, arbors and arbor drives in this area. The arrangement is further advantageous in that it provides for a relatively close positioning of rigging sets, facilitates the coupling of drive means to the arrangement and enables relatively close mounting of a locking means thereby enhancing the safety of the arrangement.

While there has been described particular embodiments of the invention, it will be apparent to those skilled in the art that variations may be made thereto without departing from the spirit of the invention and the scope of the appended claims.

What is claimed is:

1. In a theatre having a stage floor, a proscenium opening having a height and a length, an improved arrangement for elevating and lowering batten supported stage equipment relative to the stage floor comprising:

(a) a plurality of cylindrically shaped rotary bodies;

(b) said rotary bodies horizontally orientated, concentrically aligned and spaced apart in a rectilinear array;

(c) means for supporting said array aloft above the stage floor (d) drive shaft means for mechanically intercoupling said array of bodies for causing simultaneous rotation thereof;

(e) electric motor and rotary speed reducing drive means supported aloft and mechanically coupled to said array of bodies for causing simultaneous rotation thereof;

(f) an elongated batten for supporting stage equipment;

(g) said batten having a length for supporting stage equipment which extends for a distance substantially coextensive with the length of the proscenium opening;

(h) a flexible rope extending from each of said rotary bodies and coupled to said batten at spaced apart locations along the length of said batten;

(i) said rope means mounted to said rotary bodies for causing winding of a rope about an associated rotary body when said body is rotated in a first direction for elevating said batten and for unwinding said rope from said rotary body when rotated in a second opposite direction for lowering said batten, and, (j) locking means coupled to said drive shaft means for selectively enabling and inhibiting rotation of said array of bodies.

2. The apparatus of claim 1 wherein said mechanical coupling means comprises a plurality of elongaged drive shafts, said drive shafts extend between adjacent positioned rotary bodies, and demountable means for coupling said drive shaft to said rotary bodies.

3. The apparatus of claim 2 wherein said demountable means includes a coupling member in telescoping engagement with a drive shaft.

4. The apparatus of claim 1 wherein said drive means is mechanically coupled to said mechanical coupling means at an intermediate location along said rectilinear array.

5. The apparatus of claim 1 wherein said locking means is positioned at an intermediate location along said rectilinear array.

6. In a theatre having a stage floor, a proscenium opening having a height and a length, an improved arrangement for elevating and lowering batten supported stage equipment relative to the stage floor comprising:

(a) a plurality of cylindrically shaped rotary bodies;
(b) said rotary bodies horizontally orientated, concentrically aligned and spaced apart in a rectilinear array;
(c) means for supporting said array aloft above the stage floor;
(d) drive shaft means for mechanically intercoupling said array of bodies for causing simultaneous rotation thereof in a same rotary direction;
(e) an electrically energized drive means supported aloft and mechanically coupled to said array of bodies for causing simultaneous rotation thereof;
(f) an elongated batten for supporting stage equipment;
(g) said batten having a length for supporting stage equipment which extends for a distance substantially coextensive with the length of the proscenium opening;
(h) a flexible rope extending from each of said rotary bodies and coupled to said batten at spaced apart locations along the length of said batten; and,
(i) said rope means mounted to said rotary bodies for causing winding of a rope about an associated rotary body when said body is rotated in a first direction for elevating said batten and for unwinding said rope from said rotary body when rotated in a second opposite direction for lowering said batten, said ropes coupled to said rotary bodies for causing ropes of different bodies to travel in opposite directions upon rotation of said bodies.

7. The arrangement of claim 6 wherein said ropes are coupled to said rotary bodies for causing ropes of adjacent bodies to travel in oppposite directions.

8. The apparatus of claim 7 wherein said means for supporting said rectilinear array aloft comprises a plurality of support members extending transversely to said rectilinear array of rotary bodies, said support members comprise first and second spaced apart members positioned at each rotary body location along said rectilinear array, said rope extends from said rotary body in a vertical direction between said first and second transversely extending members, and said support members are spaced apart in a direction of said longitudinal array by a distance at least equal to a distance traveled by said rope in a longitudinal direction upon winding and unwinding of said rope on said rotary body.

9. In a theatre having a stage floor, a proscenium opening having a height and a length, an improved arrangement for elevating and lowering batten supported stage equipment relative to said stage floor comprising:

(a) a plurality of parallel aligned, rectilinear arrays of cylindrically shaped rotary bodies extending parallel to a length of the proscenium opening;
(b) each of said rectilinear arrays including a plurality of horizontally orientated, concentrically aligned rotary bodies, drive shaft means for mechanically intercoupling said array of bodies for causing simultaneous rotation thereof in a same rotary direction, electric motor and speed reducing drive means mechanically coupled to said rectilinear array of bodies for causing rotation therof, an elongated batten for supporting stage equipment, a plurality of flexible ropes, each of said ropes extending from a rotary body and coupled to said batten at spaced apart locations along the length of said rope for causing winding of the rope about an associated rotary body when said body is rotated in a first direction for elevating said batten and for unwinding said rope from said rotary body when rotated in a second opposite direction for lowering said batten, said bodies coupled to said rotary bodies in the same array for causing ropes of different bodies to travel in opposite longitudinal directions upon rotation of said bodies; and,
(c) means for supporting aloft above said stage floor said plurality of rectilinear arrays and said drive means associated with each of said rectilineary arrays.

10. The apparatus of claim 9 including means for supporting juxtaposed rotary bodies at different elevations above said support members.

11. The apparatus of claim 10 wherein said means for supporting said rotary bodies positions said bodies for spacing apart said bodies a distance in said transverse direction less than a diameter of said rotary bodies.

12. The arrangement of claim 9 wherein said ropes are coupled to said rotary bodies for causing ropes of adjacent bodies to travel in opposite directions.

13. The batten support arrangement of claim 12 wherein said means for supporting said arrays of rectilinear bodies aloft extends in a direction transverse to said parallel aligned rectilinear arrays, said rotary bodies of adjacent rectilinear arrays are positioned in juxtaposed relationship and are aligned in a direction transverse to the linear array, said transversely aligned rotary bodies are suported by said transversely extending support means, and said transversely extending support means comprises a plurality of support members, positioned for supporting said transversely aligned rotary bodies.

* * * * *